United States Patent [19]

Atkins et al.

[11] Patent Number: 4,705,427

[45] Date of Patent: Nov. 10, 1987

[54] EROSION CONTROL APPARATUS

[75] Inventors: David A. Atkins, Chanhassen; Donald F. Atkins, Eden Prairie, both of Minn.

[73] Assignee: Ero-Con, Inc., Eden Prairie, Minn.

[21] Appl. No.: 863,853

[22] Filed: May 16, 1986

[51] Int. Cl.[4] ..... E02B 7/00

[52] U.S. Cl. ..... 405/36; 47/56; 111/1; 405/107; 405/115

[58] Field of Search ..... 405/36, 38, 270, 52, 405/15, 107, 92, 115; 111/1, 10, 47, 56; 47/56

[56] References Cited

U.S. PATENT DOCUMENTS

| | | | |
|---|---|---|---|
| 473,009 | 4/1892 | Lyon | 405/270 |
| 1,363,690 | 12/1920 | Sullivan | 405/36 |
| 2,738,745 | 3/1956 | Harpold | 111/5 |
| 3,067,585 | 12/1962 | Hait | 405/156 |
| 3,083,542 | 4/1963 | Summers et al. | 405/179 |
| 3,086,322 | 4/1963 | Laughlin | 47/58 |
| 3,182,459 | 5/1965 | Grether et al. | 405/36 X |
| 3,298,183 | 1/1967 | Grether et al. | 405/36 |
| 3,315,623 | 4/1967 | Tschudy, Jr. | 111/1 |
| 3,327,484 | 6/1967 | Launder et al. | 405/157 |
| 3,339,369 | 9/1967 | Ryan | 405/157 |
| 3,559,599 | 2/1971 | Hoadley | 405/38 X |
| 3,618,329 | 11/1971 | Hanson | 405/38 |
| 3,905,313 | 9/1975 | Grether | 111/1 |
| 3,945,330 | 3/1976 | Leavitt et al. | 111/1 |
| 4,050,972 | 9/1977 | Cardinal, Jr. | 47/28 R |
| 4,055,126 | 10/1977 | Brown et al. | 111/1 X |
| 4,092,936 | 6/1978 | Griffin et al. | 47/56 X |
| 4,289,424 | 9/1981 | Shefbuch et al. | 405/179 |

*Primary Examiner*—Dennis L. Taylor

*Attorney, Agent, or Firm*—Orrin M. Haugen; Thomas J. Nikolai; Frederick W. Niebuhr

[57] ABSTRACT

A wheeled trailer for installing a perforated film erosion barrier from a perforated foil supply roll into the earth and along an elongated furrow path. The wheeled trailer includes frame means for supporting the system for movement along the path, with a plow shoe being disposed forwardly of the frame to create a open furrow to receive one edge of an elongated perforated film, and with a pivotal boom being provided at the rear portion of the frame for supporting a furrow-covering disc. A hydraulic ram and cylinder are provided for arranging the path of the furrow-covering disc, with the furrow-covering disc depositing soil into the furrow for covering and burying one edge of the elongated perforated film.

2 Claims, 2 Drawing Figures

EROSION CONTROL APPARATUS

BACKGROUND OF THE INVENTION

The present invention relates generally to a system for installing a perforated film soil erosion barrier from a supply roll into the earth along an elongated furrow path, and more particularly to such a system which includes means for creating the furrow, depositing or laying one edge of a perforated film or foil supply roll into the furrow, and for covering the buried foil edge with earth by filling the furrow. The apparatus of the present invention is particularly adapted for use in or on areas where top soil and/or earth has been disturbed, or in areas where soil erosion control is needed because of the slope of the terrain. The apparatus of the present invention has particular utility in the construction industry, particularly where construction is occurring on uneven, hilly or similar terrain.

Whenever earth is disturbed, it is subject to erosion because of rainfall, winds or the like. In order to preserve the quality of surface water, particularly streams and/or lakes, it is frequently a requirement that a means be provided to reduce soil erosion from such sites. Typically, a perforated plastic film is employed with one edge being buried in a furrow, and with the other being supported generally vertically upwardly from the furrow. For permanency of installation, it is generally desirable that the buried edge of the film be laid in the furrow at an angle from the vertical segment, and with the buried portion being covered with earth removed to create the furrow.

Typically, the plastic film is available in rolls 3'×900'. The apparatus of the present invention, in a single operation, creates or plows a furrow, lays the foil into the furrow (generally angularly from vertical) and covers the buried portion by a disc blade. As indicated, this operation is achieved in one pass of the apparatus.

In the past, this type of operation has generally been undertaken with hand labor, and has been, of course, highly labor-intensive. The present system provides for a wheeled trailer means to support the plow shoe for creating the furrow, a supply roll for carrying and depositing the perforated foil into the furrow, and a means for covering the furrow with the perforated foil in place therein.

SUMMARY OF THE INVENTION

Generally, in accordance with the present invention, a wheeled trailer means is provided for installing the perforated film erosion barrier from a perforated film supply roll. The trailer means includes a frame for supporting the system for movement along a predetermined path, and with the frame means including a wheeled support for the trailer, along with plow shoe means disposed forwardly of the frame for creating the film-receiving furrow. A furrow-covering disc is disposed at the rear of the frame, and a perforated film supply roll is supported in a cradle disposed generally intermediate the plow shoe and the furrow-covering disc. A trailing boom is pivotally coupled to the frame for pivotal movement about a generally vertical axis, with the trailing boom supporting the furrow-covering disc. Cable means are provided for controlling the elevation of the trailing boom relative to the frame, and a hydraulic cylinder and ram, coupled between the frame and the trailing boom, is utilized to adjustably position the furrow-covering disc relative to the frame so that the furrow-covering disc runs generally along the edge of the furrow with the perforated film in place.

It is generally a primary object of the present invention to provide an improved wheeled trailer means for installing perforated film erosion barrier from a perforated film supply roll into the earth along a furrow created for the purpose, and with means being provided to replace the earth into the furrow so as to cover one edge of the perforated film while in place.

It is a further object of the present invention to provide an improved means for installing erosion barrier film into a furrow along an elongated, predetermined furrow path, and wherein means are provided for creating the furrow, depositing one edge of the film into the furrow, and for covering the buried portion of the film, with each of these operations being undertaken by the apparatus in one pass over the site.

Other and further objects of the present invention will become apparent to those skilled in the art upon a study of the following specification, appended claims, and accompanying drawings.

IN THE DRAWINGS

FIG. 1 is a side elevational view of the wheeled trailer means of the present invention; and FIG. 2 is a top plan view of the wheeled trailer shown in FIG. 1.

DESCRIPTION OF THE PREFERRED EMBODIMENT

Figure 1:
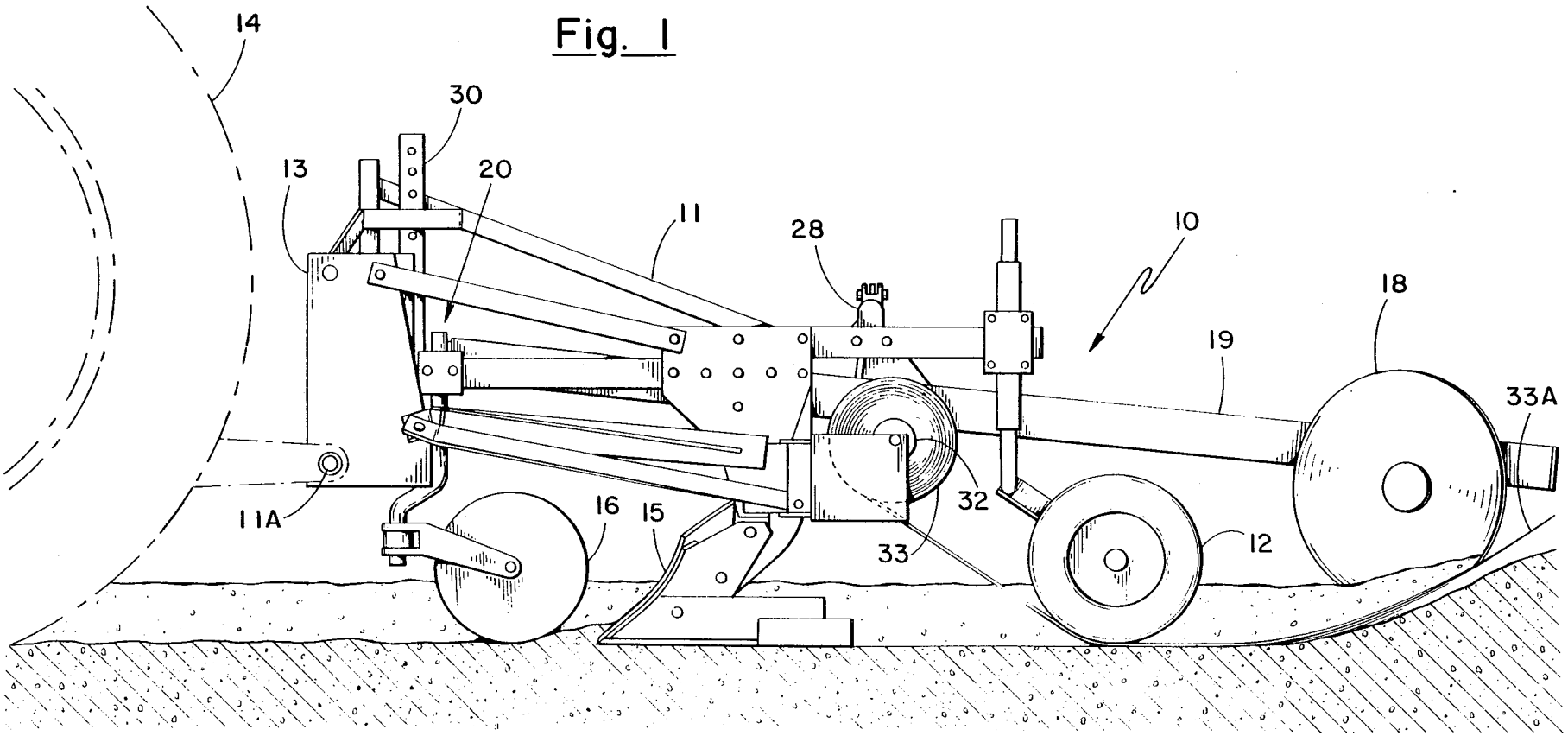

Attention is now directed to FIG. 1 of the drawings wherein the wheeled trailer erosion barrier installation means generally designated 10 is illustrated. The system includes a frame means 11 for supporting the wheeled trailer means for movement along a predetermined path, with the frame means being provided to support the individual components utilized in the overall erosion barrier installation system. A wheeled support means 12 is illustrated for the wheeled trailer means, with the support means 12 supporting the frame for movement along the path. A three-point hitch 13 is provided at the forward edge or end of the frame for attachment to a draw-bar of a conventional farm tractor or the like, a portion of which is illustrated at 14. A conventional plow shoe or share means is disposed forwardly of the frame for creating and opening a furrow along the path of movement, with the furrow being adapted to receive one edge of an elongated perforated erosion barrier film. The plow show means includes a conventional plow shoe 15, along with a laterally disposed Coulter disc 16 arranged laterally thereof and generally defining the furrow edge. The Coulter disc is utilized to cut any root or trash along the path so as to provide a defined edge for the furrow being created by the plow shoe 15. A furrow-covering disc 18 is disposed generally at the rear of the frame means 11, with the furrow-covering disc means being supported on trailing boom means 19. Trailing boom means 19 is pivotally coupled to frame means 11 for pivotal movement about a generally vertical axis through a pin and bore system shown generally at 20, with the pin and bore system including a pin 21 coupling with or mating with a bore 22 formed in the frame arm 23.

Figure 2:
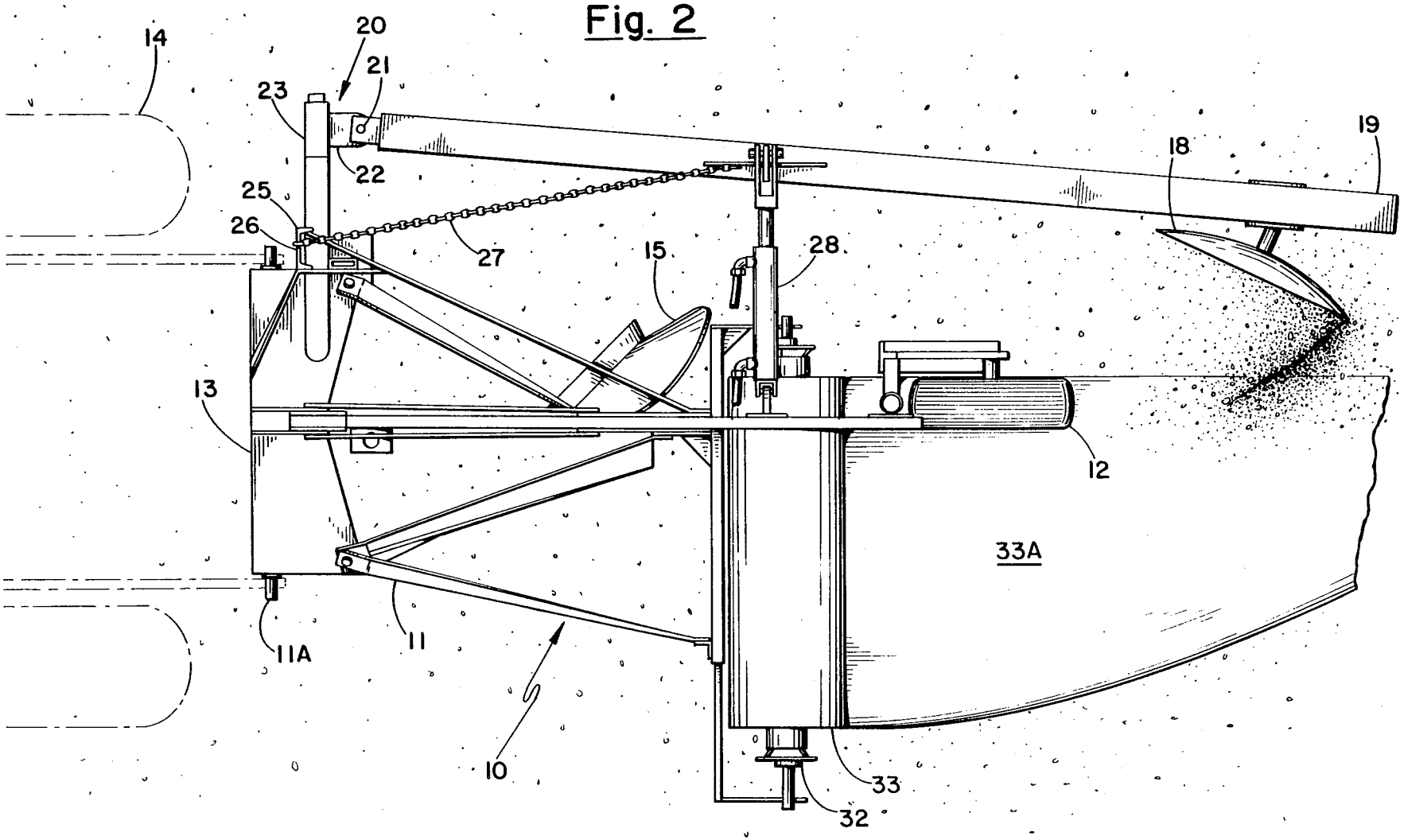

A generally vertically disposed post 25 is positioned at the forward end of the frame means to support a coupling element, port, or assembly 26 thereto. The coupling element or assembly is utilized to receive one end of a support cable means or chain 27 (shown only in FIG. 2) which is coupled between the plate 26 and the trailing boom means for controlling the vertical disposition of the furrow-covering disc 18. A double-acting hydraulic cylinder and ram is shown at 28, with the cylinder and ram being coupled between the frame means and the trailing boom means so as to adjustably position the trailing boom means relative to the frame, thereby controlling the path of travel of the furrow-covering disc along the edge of the furrow created by the plow shoe.

Conventional plow shoe or share means may be utilized, thereby reducing the cost of the overall apparatus. Also, when the system is at rest, a support stand post 30 is provided generally forwardly of the frame for supporting the system during periods of non-use, the bottom ground contacting pad support being concealed in FIG. 1. In lieu of a conventional three-point hitch, other hitches may be employed, however the coupling point hitch shown at 11A is preferred for overall operation. An upper hitch pin is normaly provided for controlling the disposition of the apparatus during pulling and/or trailering between job sites.

As indicated, the plastic film is available in roll form, with such film being available, of course, commercially. The perforations are not shown for purposes of clarity and limitations of draftsmanship. Standard widths of film include 36-inch and 48-inch rolls. Cradle means are provided for the supply roll as at 32, with the supply roll being shown in the system as at 33 with the film span 33A trailing outwardly from the roll 33.

The Coulter disc 16 is positioned laterally as well as generally ahead of the plow shoe 15, and as is conventional, is in the form of a generally planar disc. Furrow-covering disc 18 is preferably of concavoconvex configuration, also as is conventional. Support wheel 12 may be employed to hold or press the film into the furrow prior to being covered by the earth.

We claim:

1. Wheeled trailer means for installing a perforated film erosion barrier from a perforated film supply roll into the earth along an elongated furrow path and comprising:

(a) frame means for supporting said wheeled trailer means for movement along a predetermined path, said frame means including:
  (1) wheeled support means for said wheeled trailer means;
  (2) plow shoe means disposed forwardly of said frame means for creating an open furrow to receive one edge of an elongated perforated film;
  (3) a furrow-covering disc disposed at the rear of said frame means;
  (4) perforated foil supply roll support cradle means disposed generally intermediate said plow shoe means and said furrow-covering disc means for receiving a supply roll of perforated erosion barrier film thereon; and
  (5) trailing boom means pivotally coupled to said frame means for pivotal movement about a generally vertical axis supporting said furrow-covering disc; and (b) a generally vertically disposed post positioned at the forward end of said frame means, and vertical support cable means coupled between said generally vertically disposed post and said trailing boom means for controlling the vertical disposition and elevation of said furrow-covering disc; and (c) a hydraulic cylinder and ram coupled between said frame means and said trailing boom means for adjustably positioning said trailing boom means relative to said frame means for controlling the path of travel of said furrow-covering disc along the edge of the furrow created by said plow shoe means.

2. The wheeled trailer means as defined in claim 1 being particularly charcterized in that a Coulter disc is disposed along the edge of said plow shoe means.

* * * * *